US010245865B2

(12) United States Patent
Kudo et al.

(10) Patent No.: US 10,245,865 B2
(45) Date of Patent: Apr. 2, 2019

(54) RECORDING APPARATUS

(71) Applicant: SEIKO EPSON CORPORATION, Tokyo (JP)

(72) Inventors: Shoma Kudo, Shiojiri (JP); Naomi Kimura, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/918,795

(22) Filed: Mar. 12, 2018

(65) Prior Publication Data

US 2018/0272774 A1 Sep. 27, 2018

(30) Foreign Application Priority Data

Mar. 27, 2017 (JP) ..... 2017-061430

(51) Int. Cl.

| | |
|---|---|
| ***B41J 2/175*** | (2006.01) |
| ***B41J 29/17*** | (2006.01) |
| ***B41J 29/02*** | (2006.01) |
| ***B41J 29/13*** | (2006.01) |

(52) U.S. Cl.

CPC ..... *B41J 29/17* (2013.01); *B41J 2/17506* (2013.01); *B41J 2/17513* (2013.01); *B41J 2/17553* (2013.01); *B41J 2/17566* (2013.01); *B41J 29/02* (2013.01); *B41J 29/13* (2013.01); *B41J 2002/17573* (2013.01)

(58) Field of Classification Search

CPC .... B41J 29/17; B41J 2/17553; B41J 2/17513; B41J 29/02; B41J 2/17506; B41J 29/13; B41J 2/17566; B41J 2002/17573

See application file for complete search history.

(56) References Cited

U.S. PATENT DOCUMENTS

| | | | | |
|---|---|---|---|---|
| 9,427,972 | B2 * | 8/2016 | Kimura | B41J 2/17509 |
| 9,610,775 | B2 * | 4/2017 | Yanagida | B41J 2/175 |
| 2014/0043408 | A1 | 2/2014 | Kudo et al. | |

FOREIGN PATENT DOCUMENTS

| | | | |
|---|---|---|---|
| JP | 2006-205434 | A | 8/2006 |
| JP | 5958292 | B | 7/2016 |

* cited by examiner

*Primary Examiner* — Geoffrey S Mruk

(74) *Attorney, Agent, or Firm* — Workman Nydegger

(57) ABSTRACT

An object of the invention is, in a recording-apparatus liquid container having a viewing portion through which the ink level can be viewed. A printer 1 includes a carriage 11 having a recording head 10. The carriage 11 carries at least one ink tank 13 that stores the ink to be supplied to the recording head 10 and that has a filling port 15 through which the ink is poured from a refilling container 14. The ink tank 13 has a level checking portion 13*a* that is formed of a transparent material through which the liquid level can be viewed. The carriage 11 has a first viewing portion 16 through which the level checking portion 13*a* of the ink tank 13 can be viewed and a cleaning mechanism 30 that wipes off the ink deposited on the level checking portion 13*a*.

12 Claims, 14 Drawing Sheets

CLOSED STATE

OPEN STATE

CLOSED STATE

OPEN STATE

RECORDING APPARATUS

BACKGROUND

1. Technical Field

The present invention relates to recording apparatuses that perform recording on media.

2. Related Art

Ink jet printers, serving as an example of recording apparatuses, have recording heads that perform recording by discharging ink (liquid) on sheets, serving as media, and liquid containers that store the ink to be supplied to the recording heads. In some ink jet printers, the liquid containers can be refilled with ink that is consumed by recording.

Japanese Patent No. 5958292 discloses a recording apparatus of the above-described type, in which the liquid container has a viewing surface through which the ink level therein can be viewed from the outside so that a user can easily determine the timing of refilling an ink tank.

When, for example, the liquid container is refilled with ink, the ink can be deposited on the viewing surface due to scattering, leakage, or the like. The ink deposited on the viewing surface lowers the visibility of the ink level, and, if the user does not wipe off the ink immediately after the ink is deposited on the viewing surface, the removal of the ink deposited on the viewing surface becomes difficult. Depending on the position of the liquid container, it may be difficult to thoroughly wipe the viewing surface.

SUMMARY

An advantage of some aspects of the invention is that it ensures, in a liquid container that is provided in a recording apparatus, that can be refilled with ink, and that has a viewing portion through which the ink level therein can be viewed, the visibility of the viewing portion.

A recording apparatus according to a first aspect of the invention includes a recording unit that discharges liquid on a medium to perform recording; and a carriage having the recording unit and capable of moving in a width direction intersecting a medium transport direction. The carriage carries at least one liquid container that stores the liquid to be supplied to the recording unit and that has a filling port through which the liquid is poured from a refilling container. The liquid container has a level checking portion that is formed of a transparent material through which the liquid level can be viewed. The carriage has a first viewing portion through which the level checking portion of the liquid container can be viewed and a cleaning mechanism that wipes off the liquid deposited on the level checking portion.

Because the carriage is provided inside the body of the recording apparatus, when the ink scatters or leaks during refilling, it is difficult to frequently clean the level checking portion by hand. Furthermore, in this configuration in which the liquid container is loaded on the carriage, the liquid container is very close to the recording unit. Thus, the liquid discharged from the recording unit tends to be deposited on the level checking portion in the form of fine mist. According to this aspect, because the cleaning mechanism for wiping off the liquid deposited on the level checking portion is provided, good visibility of the level checking portion is maintained.

It is preferable that the cleaning mechanism be a wiping portion that can move relative to the level checking portion while being in contact therewith.

With this configuration, it is possible to wipe off the liquid deposited on the level checking portion with the wiping portion that can move relative to the level checking portion while being in contact therewith.

It is preferable that the recording apparatus further include a housing that accommodates the carriage therein and constitutes the exterior of the recording apparatus, and an opening/closing cover that opens and closes a portion of the housing and allows the level checking portion to be viewed through the first viewing portion when opened. The wiping portion may be configured to move while being in contact with the level checking portion in accordance with the opening and closing of the opening/closing cover.

With this configuration, because the wiping portion moves relative to the level checking portion so as to be in contact therewith in accordance with the opening and closing of the opening/closing cover, it is possible to wipe off the liquid deposited on the level checking portion when a user opens and closes the opening/closing cover to view the level checking portion through the first viewing portion in the carriage.

It is preferable that the recording apparatus further include a filling port cover that opens and closes the filling port in the liquid container. The wiping portion may be configured to move while being in contact with the level checking portion in accordance with the opening and closing of the filling port cover.

With this configuration, because the wiping portion moves relative to the level checking portion so as to be in contact therewith in accordance with the opening and closing of the filling port cover, it is possible to wipe off the liquid deposited on the level checking portion when a user opens and closes the filling port cover to refill the liquid container with the liquid.

It is preferable that the recording apparatus further include a housing that accommodates the carriage therein and constitutes the exterior of the recording apparatus. The wiping portion may be fixed to the housing and may be configured to move relative to the level checking portion while being in contact therewith in accordance with the movement of the carriage in the width direction.

With this configuration, it is possible to wipe off the liquid deposited on the level checking portion in accordance with the movement of the carriage in the width direction.

It is preferable that the housing that accommodates the carriage therein and constitutes the exterior of the recording apparatus have a second viewing portion through which the level checking portion can be viewed through the first viewing portion.

With this configuration, because the housing has the second viewing portion through which the level checking portion can be viewed through the first viewing portion, it is possible to easily check the liquid level of the liquid container from the outside of the recording apparatus without opening an opening/closing member, such as a cover, to expose the carriage.

It is preferable that, when the carriage is located at a home position, at least a portion of the first viewing portion and at least a portion of the second viewing portion overlap each other, and the cleaning mechanism be provided on a home-position side of the carriage.

With this configuration, when the carriage is located at the home position, the liquid level of the liquid container can be checked from the outside of the recording apparatus. For example, if the position of the carriage at which the liquid level is checked is set to a position other than the home position, the carriage needs to be moved to that position for liquid-level checking. However, such a step is unnecessary with this configuration, and it is possible to easily and quickly check the liquid level even when, for example, the recording apparatus is not operating. Furthermore, because the cleaning mechanism is provided on a home-position side of the carriage, the level checking portion is cleaned at a position near the home position, thus improving the visibility when the liquid level is checked from the second viewing portion.

It is preferable that the level checking portion be waterproofed.

With this configuration, because the level checking portion is waterproofed, the liquid on the level checking portion can be easily wiped off.

A recording apparatus according to a second aspect of the invention includes a recording unit that discharges liquid on a medium to perform recording; and a carriage having the recording unit and capable of moving in a width direction intersecting a medium transport direction. The carriage carries at least one liquid container that stores the liquid to be supplied to the recording unit and that has a filling port through which the liquid is poured from a refilling container. The liquid container has a level checking portion that is formed of a transparent material through which the liquid level can be viewed. The carriage has a first viewing portion through which the level checking portion of the liquid container can be viewed and a liquid-deposition suppressing portion that suppresses deposition of the liquid on the level checking portion.

Because the carriage is provided inside the body of the recording apparatus, it is difficult to frequently clean the level checking portion by hand. In this configuration in which the liquid container is loaded on the carriage, the liquid container is very close to the recording unit. Thus, the level checking portion is exposed to an atmosphere in which the liquid discharged from the recording unit is present in the form of fine mist, and the mist may be deposited on the level checking portion. According to this aspect, it is possible to suppress, with the liquid-deposition suppressing portion, the deposition of the liquid on the level checking portion and to maintain good visibility of the level checking portion for a long time.

It is preferable that the liquid-deposition suppressing portion include an upright portion that is provided upright in, at least, an area around the level checking portion.

This configuration suppresses the deposition of liquid on the level checking portion with the upright portion that is provided upright in, at least, an area around the level checking portion.

It is preferable that the housing that accommodates the carriage therein and constitutes the exterior of the recording apparatus have a second viewing portion through which the level checking portion can be viewed through the first viewing portion.

With this configuration, because the housing has the second viewing portion through which the level checking portion can be viewed through the first viewing portion, it is possible to easily check the liquid level of the liquid container from the outside of the recording apparatus without opening an opening/closing member, such as a cover, to expose the carriage.

It is preferable that the second viewing portion be an opening or a cutaway portion provided in the housing.

This configuration simplifies the configuration of the second viewing portion. In addition, when liquid mist is generated in the housing, the mist can be released to the outside of the recording apparatus through the opening or the cutaway portion. As a result, it is possible to suppress the deposition of mist on the components inside the recording apparatus, including the level checking portion.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
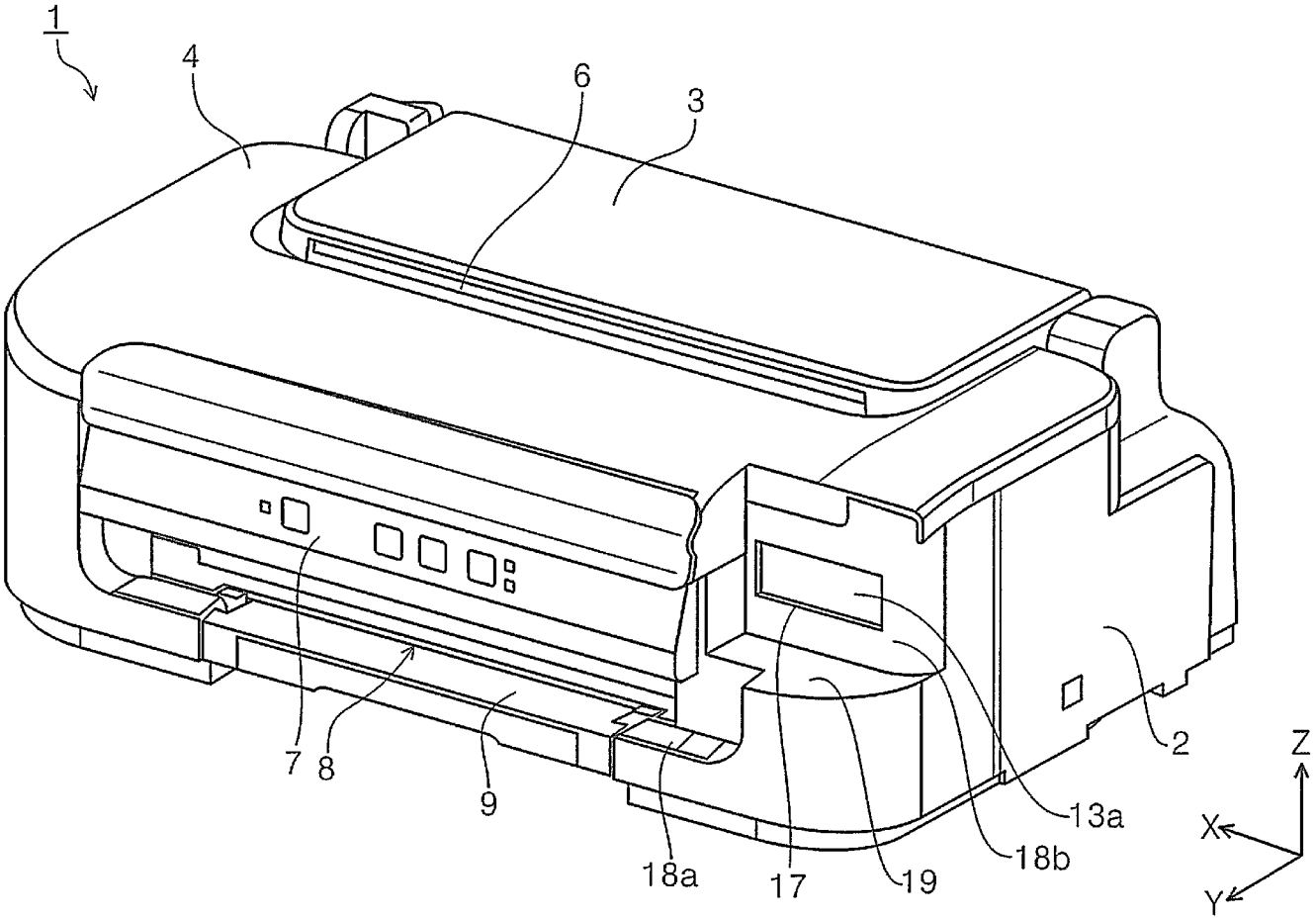
FIG. 1 is an external perspective view of an example printer of the invention.
Figure 2:
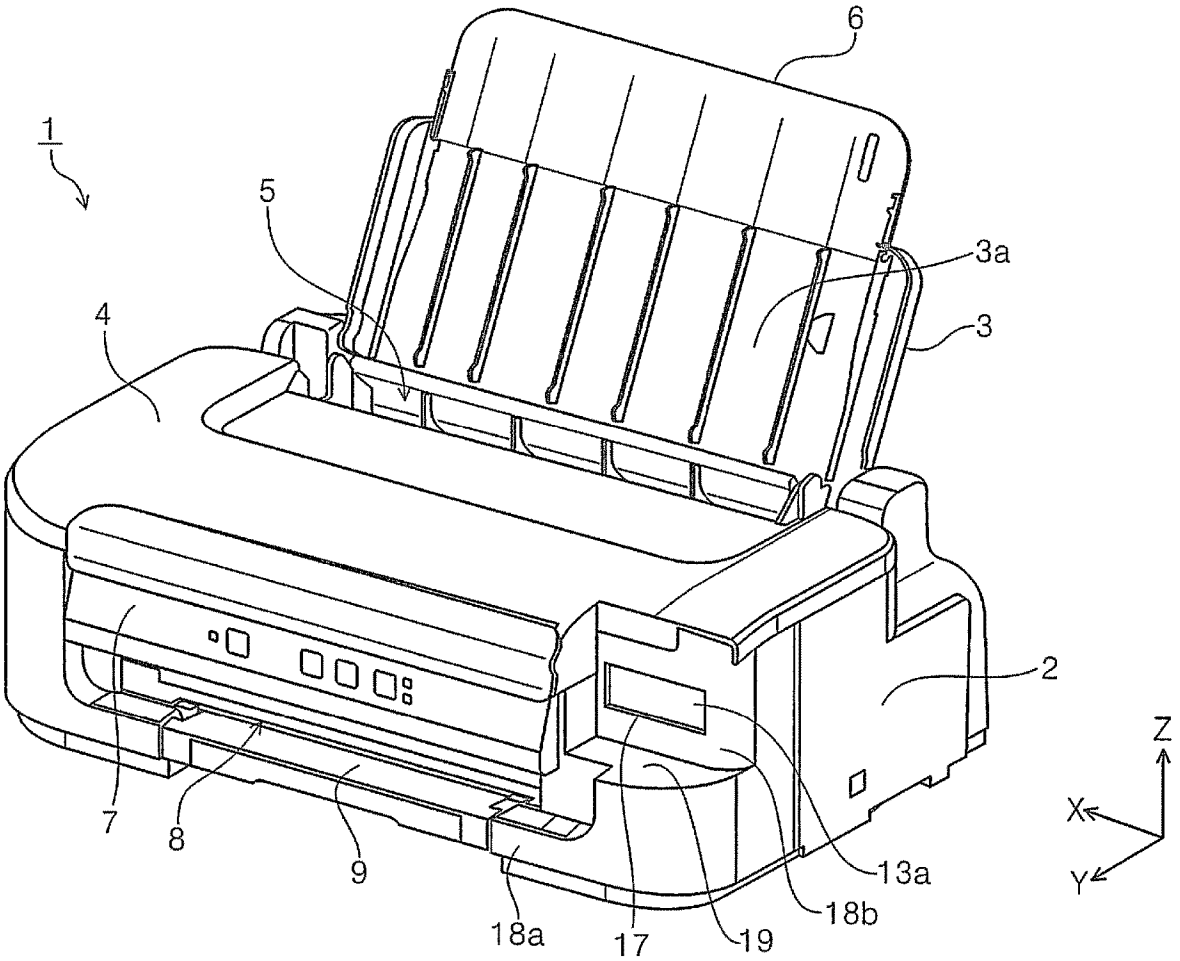
FIG. 2 is a perspective view of the printer shown in FIG. 1 with a paper support open.
Figure 3:
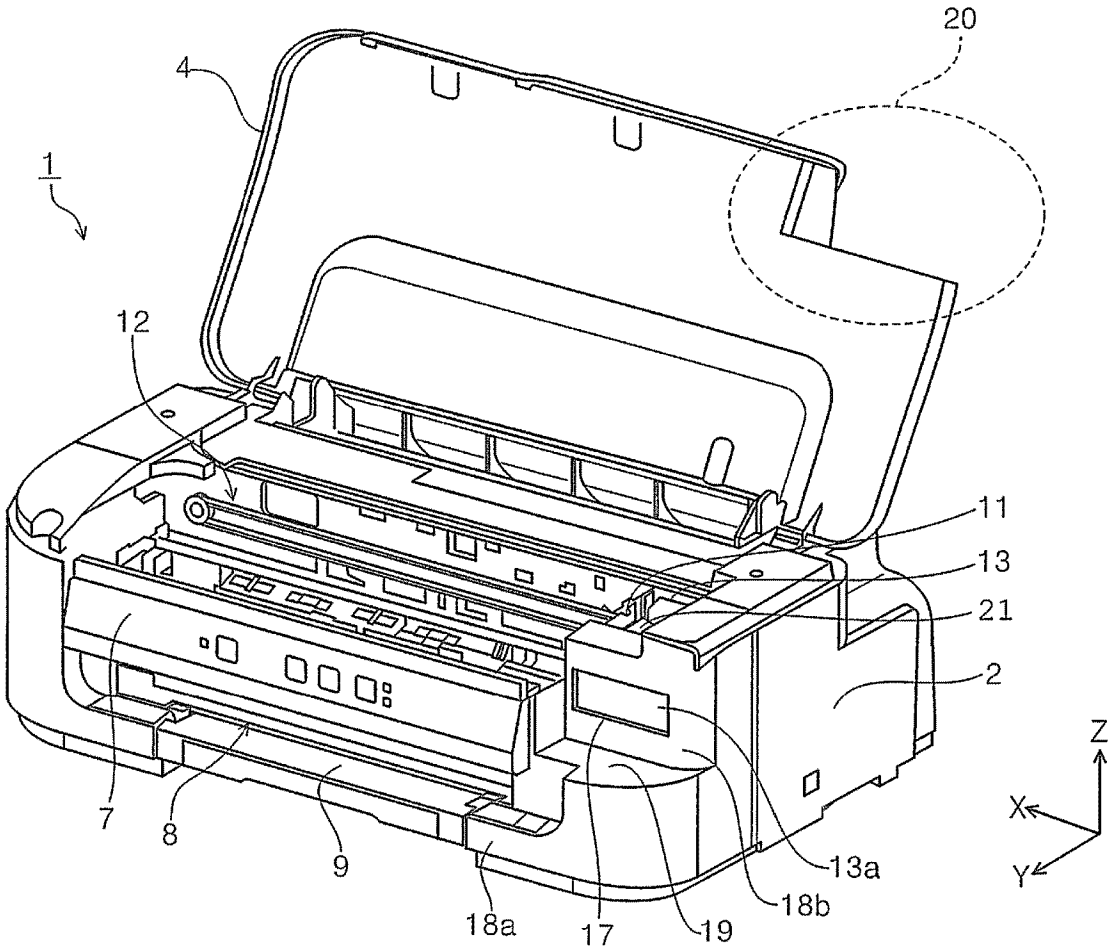
FIG. 3 is a perspective view of the printer shown in FIG. 2 with an upper cover open.
Figure 4:
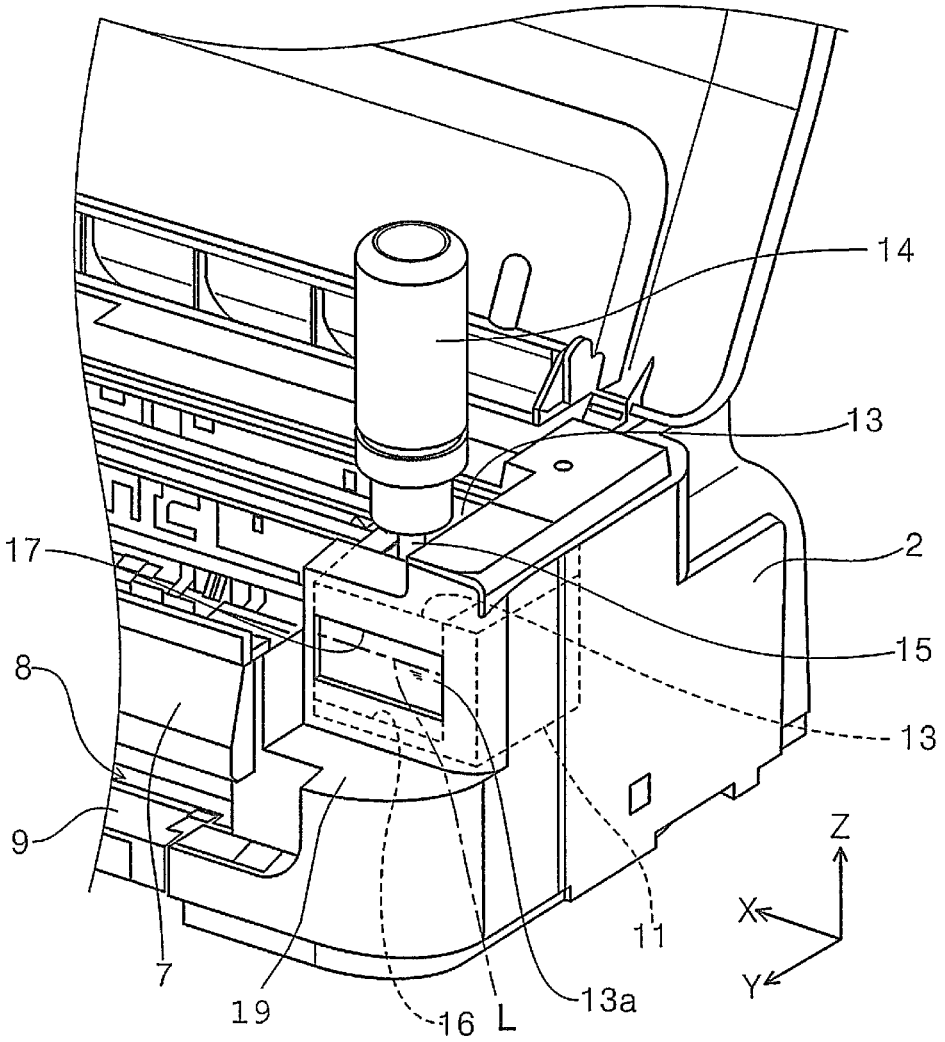
FIG. 4 is a perspective view showing a state in which a refilling container is attached to a filling port in an ink tank.
Figure 5:
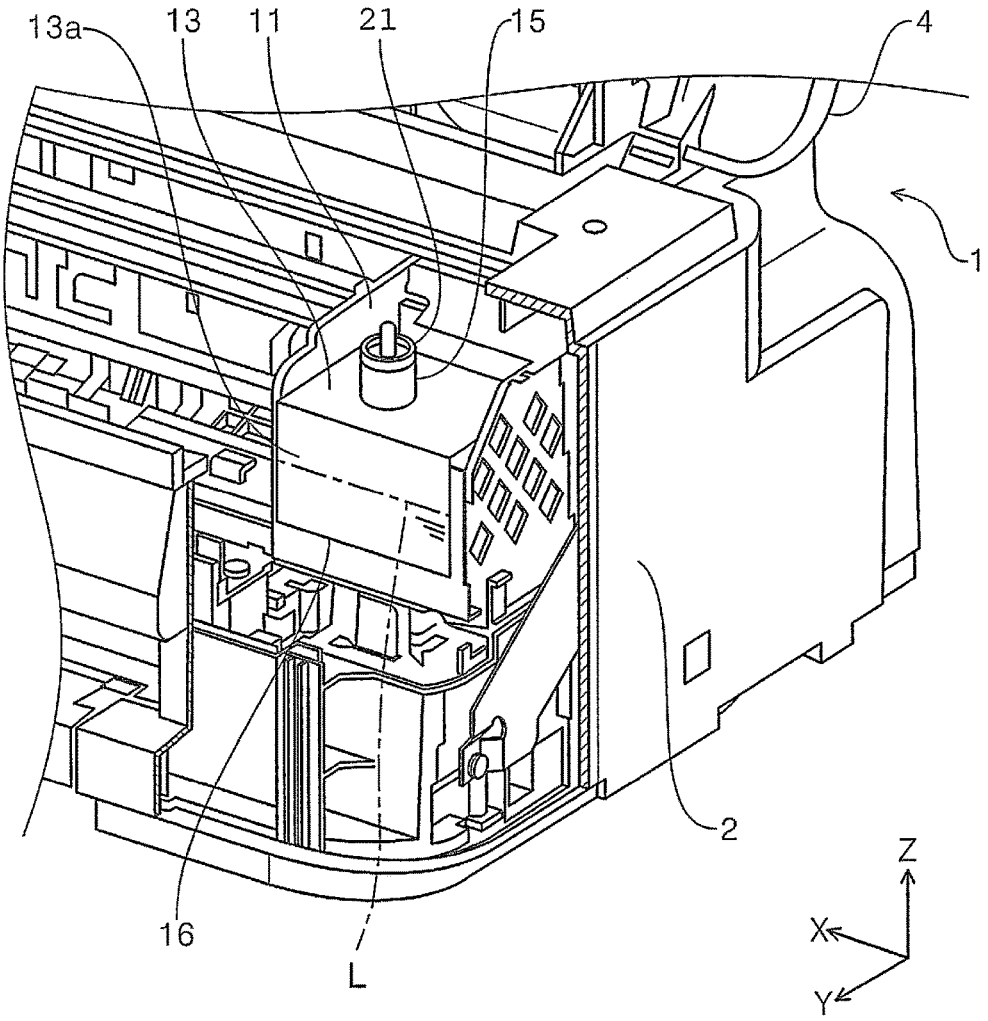
FIG. 5 is an enlarged perspective view of the relevant part shown by partially cutting away a housing.
Figure 6:
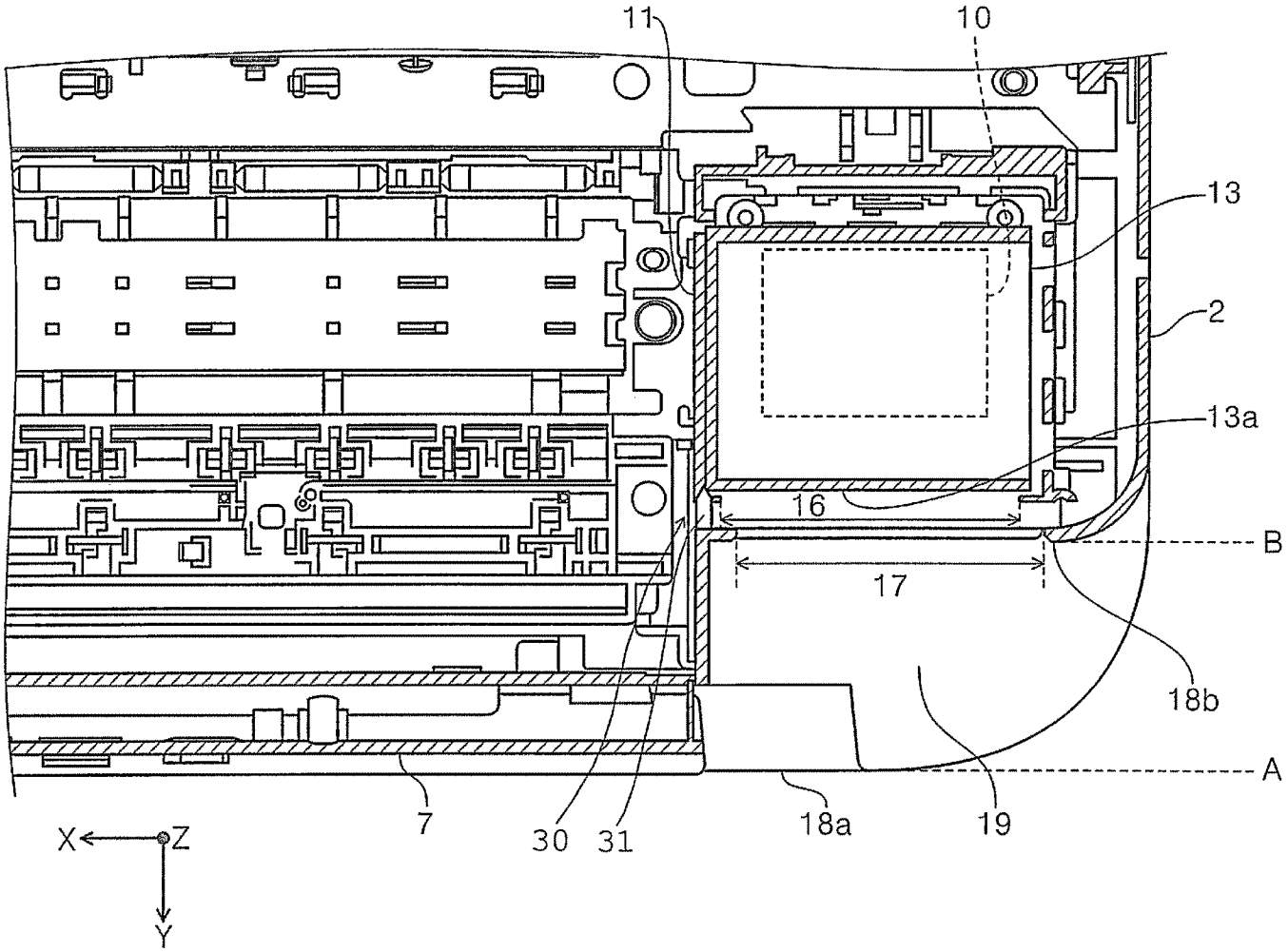
FIG. 6 is an enlarged sectional view of the relevant part of the printer.
Figure 7A:
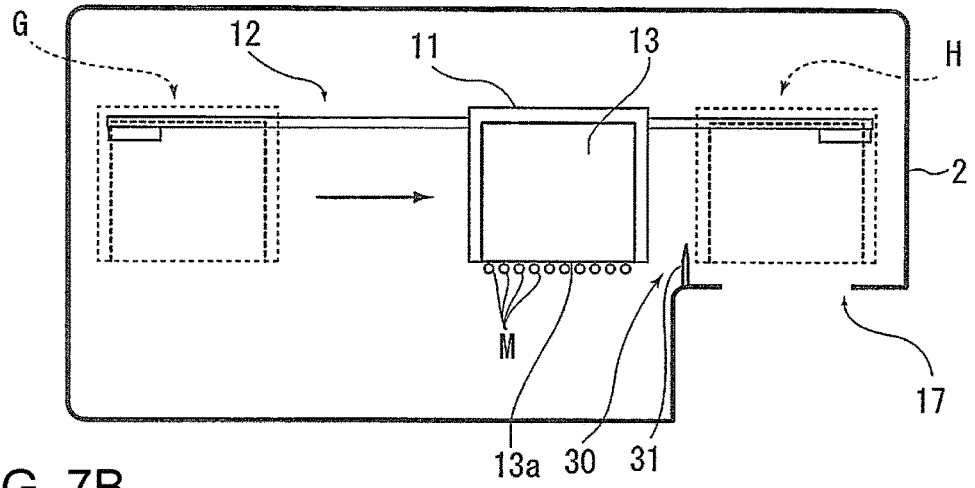
FIGS. 7A to 7C show a wiping operation performed by a cleaning mechanism according to the first embodiment.
Figure 7B:
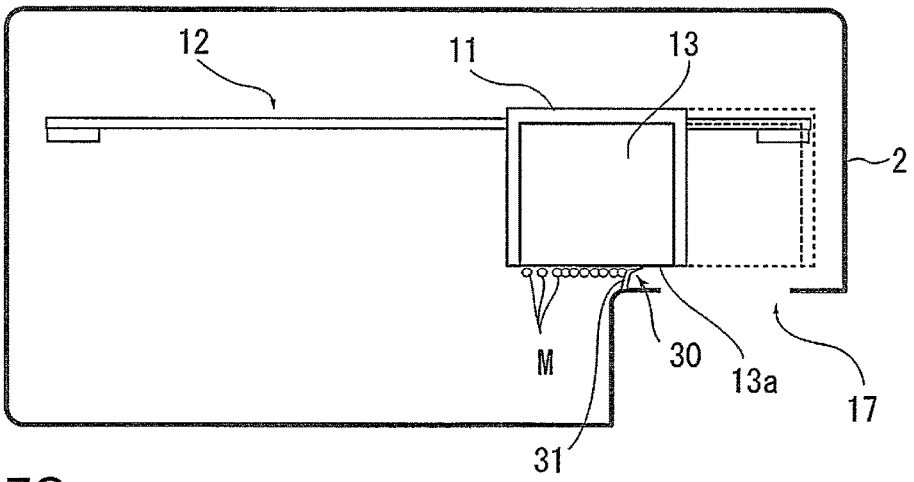
Figure 7C:
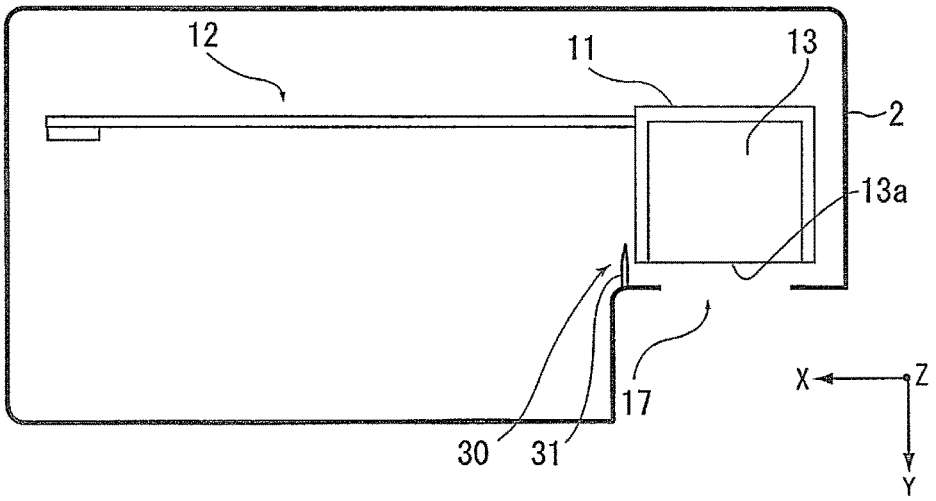

First, the outline of a recording apparatus according to an embodiment of the invention will be described. In this embodiment, an ink jet printer 1 (herein below, simply, a printer 1), serving as an example of a recording apparatus, will be described. FIG. 1 is an external perspective view of an example printer of the invention. FIG. 2 is a perspective view of the printer shown in FIG. 1 with a paper support open. FIG. 3 is a perspective view of the printer shown in FIG. 2 with an upper cover open. FIG. 4 is a perspective view showing a state in which a refilling container is attached to a filling port in an ink tank. FIG. 5 is an enlarged perspective view of the relevant part shown by partially cutting away a housing. FIG. 6 is an enlarged sectional view of the relevant part of the printer. FIGS. 7A to 7C show a wiping operation performed by a cleaning mechanism according to the first embodiment.

In the XYZ coordinate system shown in each drawing, the X direction corresponds to the direction in which the recording head moves, as well as the width direction of the recording apparatus, the Y direction corresponds to the depth direction of the recording apparatus, and the Z direction corresponds to the height direction of the recording apparatus. In each drawing, the +Y direction corresponds to the front-surface side or front side of the recording apparatus, and the −Y direction corresponds to the back-surface side or rear side of the recording apparatus. As viewed from the front-surface side of the recording apparatus, the left side is the +X direction, and the right side is the −X direction. The +Z direction is the upper side of the recording apparatus (including the upper part, the top surface, etc.), and the −Z direction is the lower side of the recording apparatus (including the lower part, the lower surface, etc.).

Overall Configuration of Printer

Referring to FIGS. 1 to 6, the overall configuration of the printer 1 will be described. The exterior of the printer 1 (FIG. 1) is formed of: a housing 2 accommodating a recording head 10 (FIG. 6, described below), serving as a "recording unit", therein; a paper support 3 having a rotation shaft on the back-surface side of the housing 2 and capable of being opened and closed; and an upper cover 4 that opens and closes the upper part of the housing 2.

As shown in FIG. 2, when the paper support 3 is opened, a set port 5 provided in the upper part of the housing 2 is exposed. Sheets, serving as "media", are fed to the set port 5. The paper support 3 is a cover that opens and closes the area including the set port 5 in the upper part of the housing 2. As shown in FIG. 2, the paper support 3 in an open state forms a slope and supports the sheets set in the set port 5 with a support surface 3*a*. The paper support 3 has an auxiliary paper support 6 that can be stored therein and pulled out therefrom. As shown in FIG. 2, longer sheets can be stably supported by pulling out the auxiliary paper support 6.

A sheet set in the set port 5 is fed in the +Y direction by a transport device (not shown). Then, the recording head 10 (FIG. 6) performs recording in the housing 2, and the sheet after recording is discharged from a discharge portion 8 provided in the front surface of the housing 2.

As shown in FIG. 3, when the upper cover 4 is opened, the inside of the housing 2 is exposed. A carriage 11 having a recording head 10 (FIG. 6) that discharges ink, serving as "liquid", on the sheet to perform recording is provided inside the housing 2. The recording head 10 is provided at the bottom, that is, on the −Z direction side, of the carriage 11 and cannot be viewed in FIG. 3. The carriage 11 is moved in the width direction (X direction) intersecting the medium transport direction (+Y direction) by a belt moving mechanism 12. The upper cover 4 covers the area in which the carriage 11 moves.

The carriage 11 has an ink tank 13, serving as a "liquid container", that stores ink (liquid) to be supplied to the recording head 10. In this embodiment, although the carriage 11 carries a single ink tank 13 for one color (black color), the carriage 11 may carry a plurality of liquid containers for a plurality of colors. In this embodiment, the ink tank 13 has a filling port 15 through which ink can be poured from a refilling container 14 (FIG. 4). The filling port 15 is usually closed by a cap 21 (FIGS. 3 and 5). When the ink tank 13 is refilled with ink, the cap 21 is removed, and the refilling container 14 is attached to the filling port 15, as shown in FIG. 4. The ink tank 13 is configured such that the liquid level therein can be checked. This feature will be described in detail below.

In this embodiment, an operation panel 7, which accepts operation inputs to the printer 1, is provided in the front surface of the housing 2. The operation panel 7 is provided above the discharge portion 8. A discharged-sheet tray 9 that can be pulled out is provided in the discharge portion 8.

Configuration for Checking Liquid Level in Ink Tank Level Checking Portion

The ink tank 13 has, at least in a portion thereof, a level checking portion 13*a* (FIG. 5) that is formed of a transparent material through which the liquid level therein can be viewed. The liquid surface L in the ink tank 13 can be viewed through the level checking portion 13*a*. In this embodiment, the entirety of the ink tank 13, including the level checking portion 13*a* located on the front side of the recording apparatus (+Y direction side), is formed of a transparent or semitransparent resin material (e.g., a plastic containing polyethylene, polystyrene, or the like). Only the level checking portion 13*a* on the front side of the recording apparatus needs to be formed of a transparent or semitransparent resin material, and the rest of the ink tank 13 may be formed of a non-transparent material. Although not shown, the level checking portion 13*a* has a lower limit indicator that indicates the ink level, an upper limit indicator that indicates the maximum ink capacity, graduation marks formed therebetween, etc.

The printer 1 has a wiper 31 (FIG. 6), serving as a "wiping portion", constituting a cleaning mechanism 30 for wiping the liquid deposited on the level checking portion 13*a*, which characterizes the invention. Because the carriage 11 that carries the ink tank 13 having the level checking portion 13*a* is provided inside the housing 2, even if ink scatters or leaks during refilling, frequent cleaning of the level checking portion 13*a* by hand is difficult. Furthermore, because the ink tank 13 is very close to the recording head 10, the mist of ink (ink mist) discharged from the recording head 10 tends to be deposited on the level checking portion 13*a*. Hence, the level checking portion 13*a* is cleaned with the cleaning mechanism 30 to keep good visibility of the level checking portion 13*a*. The detailed configuration of the cleaning mechanism 30 will be described in detail below after the first viewing portion 16 (FIG. 5) and the second viewing portion 17 (FIG. 4) are described.

First Viewing Portion

The carriage 11 carrying the ink tank 13 has a first viewing portion 16 (FIG. 5) through which the level checking portion 13*a* of the ink tank 13 can be viewed. More specifically, as shown in FIG. 5, the carriage 11 has an open-top box shape, and the ink tank 13 is fitted into the box-shaped carriage 11. The first viewing portion 16 is formed by cutting away a portion of the front (+Y-direction-side) side surface of the carriage 11.

Because the carriage 11 has the first viewing portion 16, it is possible to view the level checking portion 13*a* with the ink tank 13 being loaded on the carriage 11. The first viewing portion 16 is provided in the front side surface of the carriage 11. Thus, a user can easily view the level checking portion 13*a*. In addition, because the ink tank 13 having the level checking portion 13*a* is provided above the recording head 10 (FIG. 6), the level checking portion 13*a* and the first viewing portion 16 are of course located above the recording head 10. This raises the eye level of the user who is views the liquid level, thus improving the visibility even more.

In this embodiment, although the first viewing portion 16 is formed by cutting away a portion of the front side surface of the carriage 11, it may be formed as, for example, an opening penetrating through the side surface. By providing a cut-away portion or an opening in the side surface of the carriage 11, the first viewing portion 16 can be easily formed.

Second Viewing Portion

In the printer 1, the level checking portion 13*a* of the ink tank 13 can also be viewed from the outside of the recording apparatus. More specifically, the housing 2 has a second viewing portion 17 (FIG. 4) that allows a user to view the level checking portion 13*a* through the first viewing portion 16. The second viewing portion 17 is provided as an opening in the housing 2.

In this embodiment, the second viewing portion 17 in the housing 2 is provided such that, when the carriage 11 is located at the home position, at least a portion of the first viewing portion 16 overlaps at least a portion of the second viewing portion 17 (FIGS. 4 and 6). That is, when the carriage 11 is located at the home position, the liquid level of the ink tank 13 can be checked from the outside of the recording apparatus. In this embodiment, the home position of the carriage 11 is set at the right (−X-direction) end in the moving area of the carriage 11, in the front view of the printer 1. FIGS. 3 to 6 show the carriage 11 at the home position.

As described above, because the first viewing portion 16 is provided in the front (+Y-direction-side) side surface of the carriage 11, the second viewing portion 17 is also provided in a front side surface 18*b* (FIGS. 1 and 6) of the housing 2.

The second viewing portion 17 provided in the housing 2 provides the following advantages. That is, the liquid level of the ink tank 13 can be easily checked from the outside of the printer 1 without opening the upper cover 4 to expose the carriage 11. Furthermore, in this embodiment, because the second viewing portion 17 is provided in the front side surface 18*b* (FIG. 1) of the housing 2, the user can easily view the liquid level of the ink tank 13.

If, for example, the position of the carriage 11 at which the liquid level is checked is set to a position other than the home position, the carriage 11 needs to be moved to that position when the liquid level is checked. However, in this configuration in which the second viewing portion 17 overlaps the first viewing portion 16 when the carriage 11 is located at the home position, such a step is unnecessary, and thus, the liquid level can be easily and quickly checked even when, for example, the printer 1 is not operating.

In addition, the second viewing portion 17, which is an opening, is easy to form, and, when, for example, ink mist is generated inside the recording apparatus as a result of discharge of ink from the recording head 10, the ink mist can be released to the outside of the recording apparatus through the second viewing portion 17. As a result, it is possible to suppress the deposition of ink mist on the components inside the recording apparatus, and consequently, to suppress various inconveniences.

Cleaning Mechanism

A detailed configuration of the cleaning mechanism 30 will be described below with reference to mainly FIGS. 6 and 7. In this embodiment, the cleaning mechanism 30 (FIGS. 6 and 7) includes a wiper 31 (wiping portion) that can move relative to the level checking portion 13*a* while being in contact therewith.

The wiper 31 is fixed to the housing 2. As the carriage 11 moves in the width direction (X direction), the wiper 31 moves relative to the level checking portion 13*a* while being in contact therewith. The wiper 31 is provided on the home-position side, which is at the −X direction end of the moving area of the carriage 11. Thus, the level checking portion 13*a* is cleaned at a position near the home position.

A detailed cleaning operation will be described with reference to FIGS. 7A to 7C. As shown in FIG. 7A, when the carriage 11 moves from the +X-direction end (shown by reference sign G in FIG. 7A) to the home position (shown by reference sign H in FIG. 7A), ink mist M resulting from the ink discharged from the recording head 10 during recording may be deposited on the level checking portion 13*a*. At this time, as the carriage 11 returns to the home position H, the wiper 31 provided immediately before (on the +X direction side of) the home position H in FIG. 7A moves relative to the level checking portion 13*a* while being in contact therewith and thus wipes the level checking portion 13*a*, as shown in FIG. 7B. As a result, when the carriage 11 is located at the home position H, the level checking portion 13*a* of the ink tank 13 is clean.

The wiper 31 may be formed of, for example, a material that can absorb liquid, such as the wiped ink and ink mist, and examples of such a material include a foam body and a porous body, such as a sponge.

This way, a simple configuration for wiping the level checking portion 13*a* with the wiper 31 can be achieved. The wiper 31 can wipe the level checking portion 13*a* also when the carriage 11 moves from the home position H to the end position G on the opposite side. As described above, in this embodiment, when the carriage 11 is located at the home position, at least a portion of the first viewing portion 16 overlaps at least a portion of the second viewing portion 17, so that a user can check the liquid level of the ink tank 13 by viewing the second viewing portion 17 from the outside of the recording apparatus. Because the wiper 31 (cleaning mechanism 30) is provided near the home position of the carriage 11, it is possible to clean the level checking portion 13*a* at a position near the home position to improve the visibility of the level checking portion 13*a* viewed from the second viewing portion 17.

The level checking portion 13*a* may be waterproofed. A resin water repellent, such as a silicone resin or a fluororesin, may be used in waterproofing. By waterproofing the level checking portion 13*a*, the ink and ink mist is repelled from the surface of the level checking portion 13*a*. Thus, the level checking portion 13*a* can be even more easily wiped with the wiper 31.

Other Configurations of Second Viewing Portion

Other configurations related to the second viewing portion 17 described in the first embodiment will be described below. As described above, the second viewing portion 17 is provided in the front side surface 18*b* (FIGS. 1 and 6). The side surface 18*b* is located behind a side surface 18*a* (FIGS. 1 and 6) on which the operation panel 7 and the like are provided at the front side of the recording apparatus. As shown in FIG. 6, in the housing 2, the carriage 11 is located slightly away from the front side toward the rear side in the depth direction of the recording apparatus. If the housing 2 has a substantially rectangular shape in plan view, the second viewing portion 17 provided on the front side of the recording apparatus needs to be provided in the side surface 18*a*, together with the operation panel 7 and the like, which increases the distance between the second viewing portion 17 and the first viewing portion 16.

To counter this problem, the housing 2 has a recess 19 to bring the front side surface 18*b*, in which the second viewing portion 17 is provided, toward the first viewing portion 16 of the carriage 11 located inside the housing 2 (FIGS. 1 and 6). By providing the recess 19 in the housing 2, it is possible to provide the second viewing portion 17 in the side surface 18*b*, which is located at a position B (FIG. 6) behind a position A (FIG. 6) of the side surface 18*a*. This way, the second viewing portion 17 is brought closer to the first viewing portion 16, thus making it easy to view the liquid level of the ink tank 13 from the second viewing portion 17.

Furthermore, in this embodiment, the upper cover 4 in a closed state (FIG. 1) does not cover the upper part of the recess 19. More specifically, the upper cover 4 has a cutaway portion (a portion denoted by reference sign 20 in FIG. 3) on the front right side thereof in a closed state, such that it, in a closed state, does not to cover the recess 19 when the printer 1 is viewed from above. It would be natural that a user would view the second viewing portion 17 from the upper front side of the printer 1 when checking the liquid level of the ink tank 13. Hence, this configuration, in which the upper cover 4 does not cover the upper part of the recess 19, allows the user to easily check the liquid level from the second viewing portion 17.

Furthermore, in the housing 2 (FIG. 1), at least a portion of the operation panel 7 provided in the front side surface 18*a* and the at least a portion of the second viewing portion 17 provided in the side surface 18*b* overlap in the height direction of the recording apparatus (Z direction). In other words, when the printer 1 is viewed from the front, the operation panel 7 and the second viewing portion 17 are located at substantially the same height. This allows the user to view both the operation panel 7 and the second viewing portion 17 at substantially the same eye level and also improves the appearance of the recording apparatus.

Furthermore, in this embodiment, in the housing 2, the second viewing portion 17 is located above the discharge portion 8 (FIG. 1). By providing the second viewing portion 17 at a higher position in the printer 1, the user can easily view the level checking portion 13*a* from the second viewing portion 17.

In this embodiment, although the second viewing portion 17 is formed as an opening in the housing 2, it may be formed as a cutaway portion. Furthermore, the second viewing portion 17 may be formed as a window in which an opening is covered with, for example, a material having a transparency, such as a transparent plastic or glass, through which the level checking portion 13*a* can be viewed. By covering the second viewing portion 17 with a transparent or semitransparent member, entrance of dust or the like into the housing 2 can be suppressed.

The first viewing portion 16 (carriage 11) and the second viewing portion 17 (housing 2) do not necessarily have to be provided in the front side surface 18*b*, as shown in FIG. 1. For example, the first viewing portion 16 may be provided in the right side surface of the carriage 11, and the second viewing portion 17 may be provided in the right side surface of the housing 2. By doing so, it is possible to check the liquid level inside the ink tank 13 from the right side surface of the recording apparatus when the carriage 11 is located at the home position. It is also possible to configure such that the liquid level in the ink tank is checked from the top-surface side of the recording apparatus. In that case, it is desirable to incline the level checking portion 30*a* in the ink tank 13. By doing so, the liquid level in the ink tank can be easily checked from above.

Second Embodiment

Figure 8A:
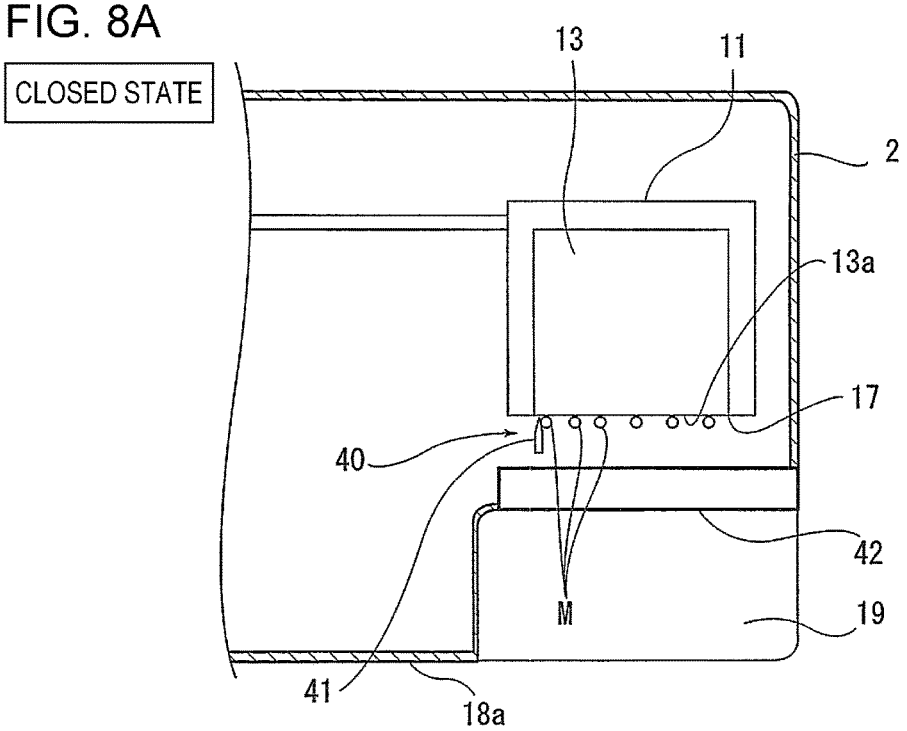
FIGS. 8A and 8B show a wiping operation performed by a cleaning mechanism according to the second embodiment.
Figure 8B:
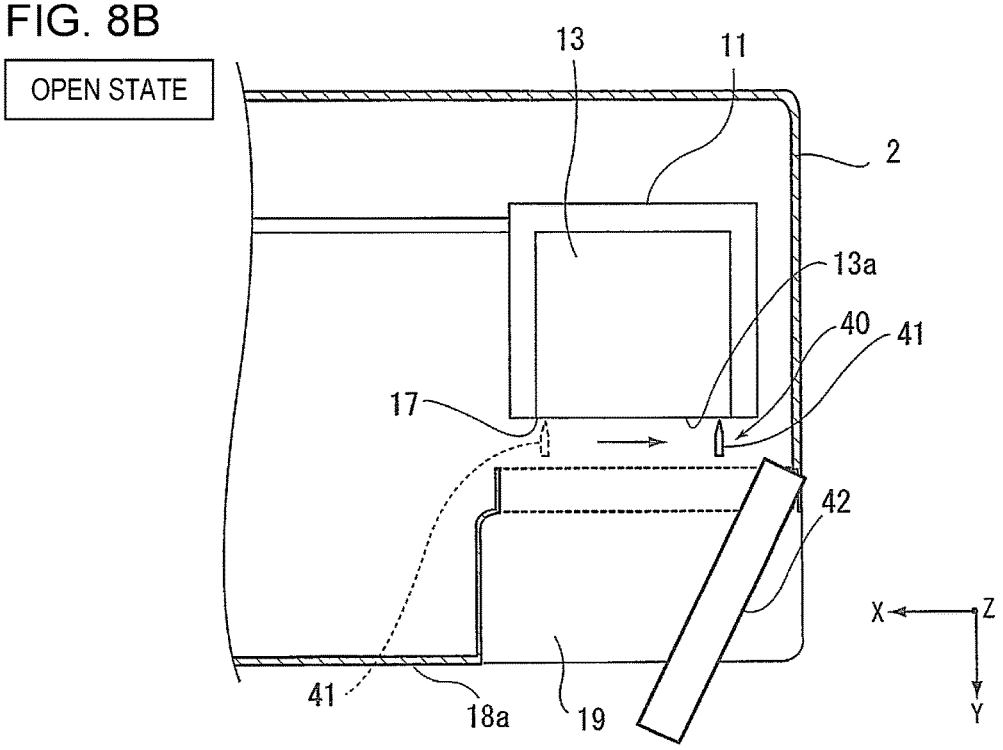
Figure 9A:
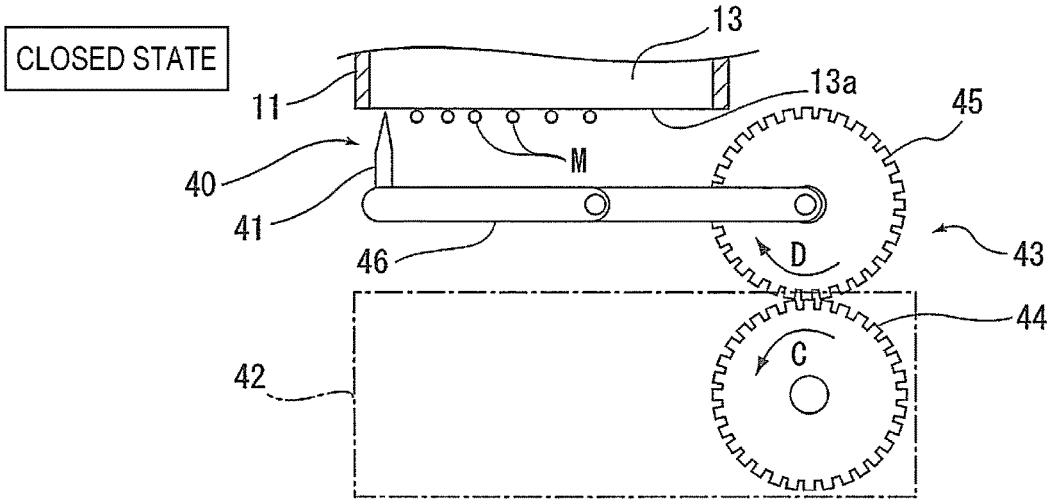
FIGS. 9A and 9B show a wiper moving mechanism in the cleaning mechanism according to the second embodiment.
Figure 9B:
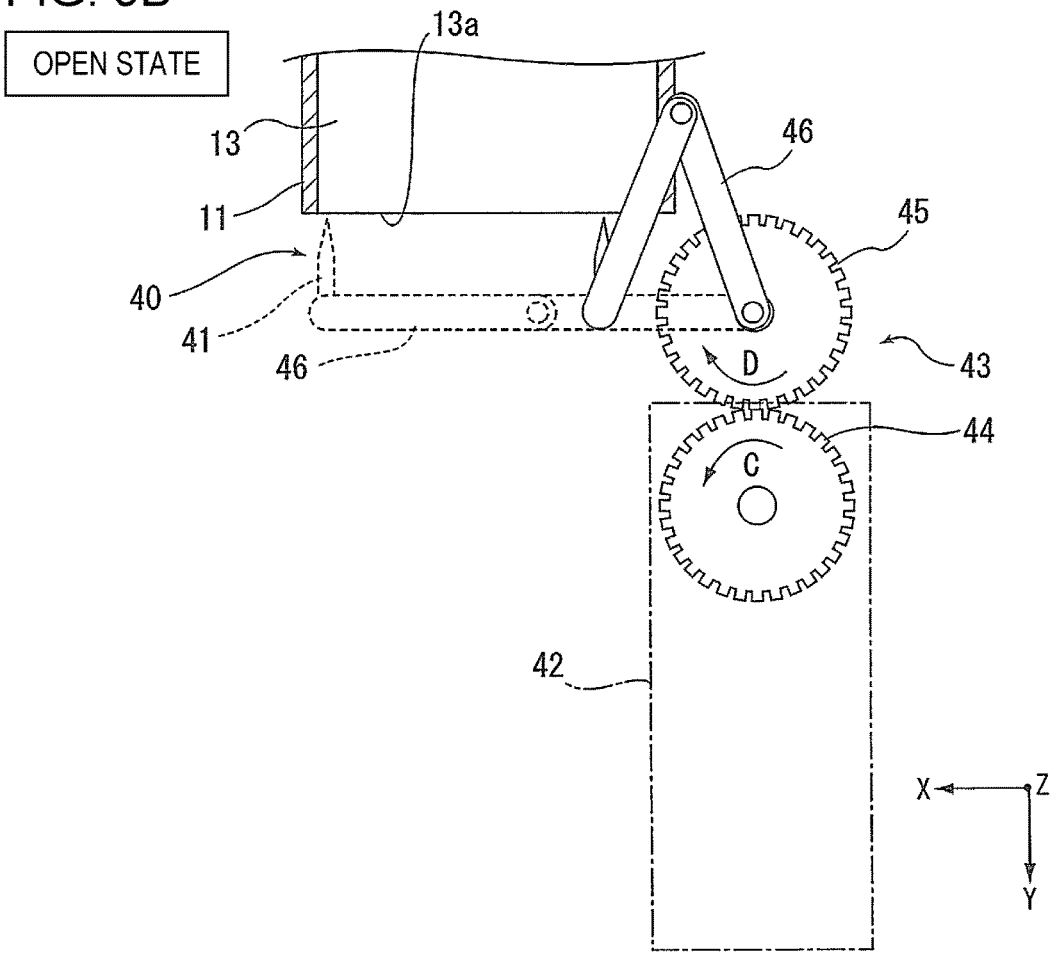

In the second embodiment, other examples of the cleaning mechanism of the invention will be described with reference to FIGS. 8A to 9B. FIGS. 8A and 8B show a wiping operation performed by a cleaning mechanism according to a second embodiment. FIGS. 9A and 9B show a wiper moving mechanism in the cleaning mechanism according to the second embodiment. In this and subsequent embodiments, the components the same as those in the first embodiment will be denoted by the same reference signs, and the descriptions thereof will be omitted by referring to, as appropriate, the drawings related to the first embodiment.

A cleaning mechanism 40 (FIGS. 8A and 8B) according to the second embodiment is configured such that, in a state in which the carriage 11 is stopped at the home position (−X direction end), the wiper 41 (wiping portion) moves relative to the level checking portion 13*a* of the ink tank 13 to wipe the level checking portion 13*a*. In this embodiment, the housing 2 has an opening/closing cover 42 (FIGS. 8A and 8B). When the opening/closing cover 42 is opened, the level checking portion 13*a* can be viewed through the first viewing portion 16. The opening/closing cover 42 opens and closes a portion of the housing 2 and is provided so as to open and close the front side surface 18*b* (FIG. 4), in which the second viewing portion 17 is provided in the first embodiment. In this embodiment, the opening/closing cover 42 serves as a "second viewing portion" when it is opened.

The cleaning mechanism 40 is configured such that the wiper 41 moves while being in contact with the level checking portion 13*a* in accordance with opening/closing of the opening/closing cover 42. In this embodiment, when the opening/closing cover 42 is closed (FIG. 8A), the wiper 41 is located on the +X-direction side of the level checking portion 13*a*, and when the opening/closing cover 42 is opened (FIG. 8B), the wiper 41 moves toward the −X direction side.

The wiper 41 can be moved in accordance with opening/closing of the opening/closing cover 42 by using, for example, a moving mechanism 43 (FIGS. 9A and 9B) that changes a turning operation of the opening/closing cover 42 to a moving operation in the X direction. For example, the moving mechanism 43 includes a first gear 44 provided coaxially with the rotation shaft of the opening/closing cover 42, a second gear 45 to mesh with the first gear 44, and a linkage 46 provided on the second gear 45. The wiper 41 is provided at an end of the linkage 46.

When the opening/closing cover 42 in a closed state (FIGS. 8 A and 9A) is opened (FIGS. 8B and 9B), the first gear 44 rotates in an arrow C direction, and the second gear 45 rotates in an arrow D direction. When the second gear 45 rotates in the arrow D direction, the linkage 46 is folded so as to pull the wiper 41, thus moving the wiper 41 in the −X direction. FIG. 9B shows, by a dashed line, the positions of the wiper 41 and the linkage 46 before being moved. When the opening/closing cover 42 is closed, the wiper 41 moves in the +X direction by the operations reverse to those performed when the opening/closing cover 42 is opened.

As a result of the wiper 41 moving while being in contact with the level checking portion 13*a* in accordance with opening/closing of the opening/closing cover 42, it is possible to wipe off the liquid deposited on the level checking portion 13*a* (for example, ink mist M) when the opening/closing cover 42 is opened to view the level checking portion 13*a*.

Third Embodiment

Figure 10A:
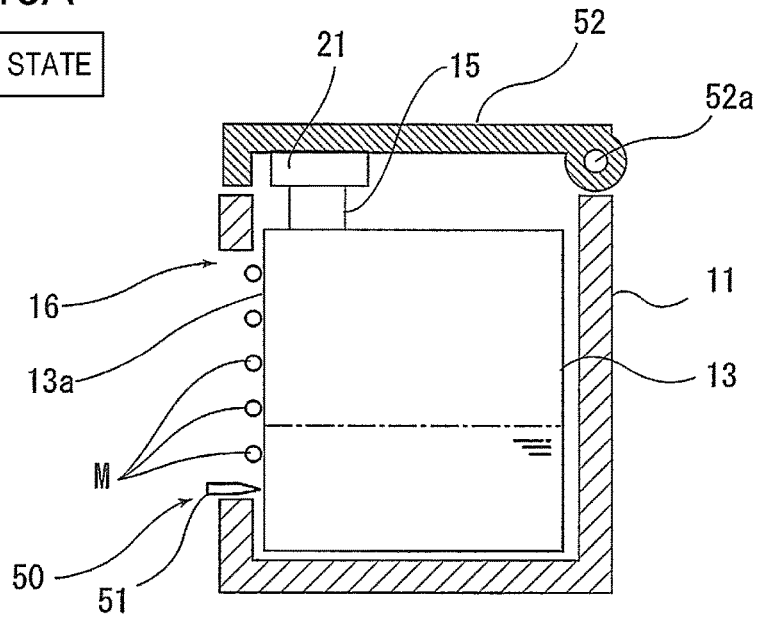
FIGS. 10A and 10B show a wiping operation performed by a cleaning mechanism according to the third embodiment.
Figure 10B:
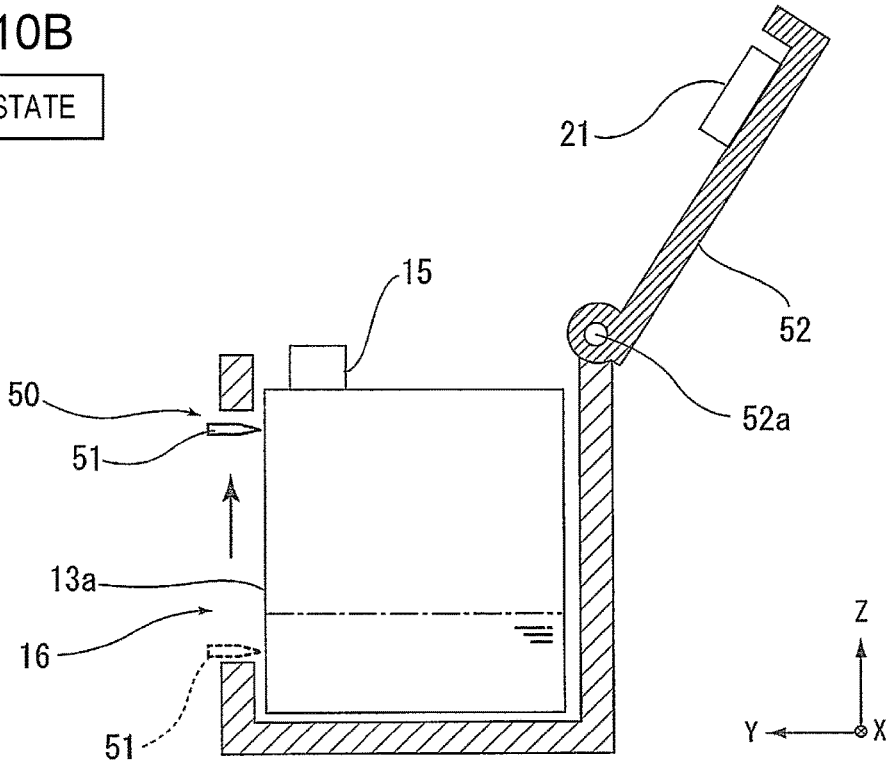
Figure 11A:
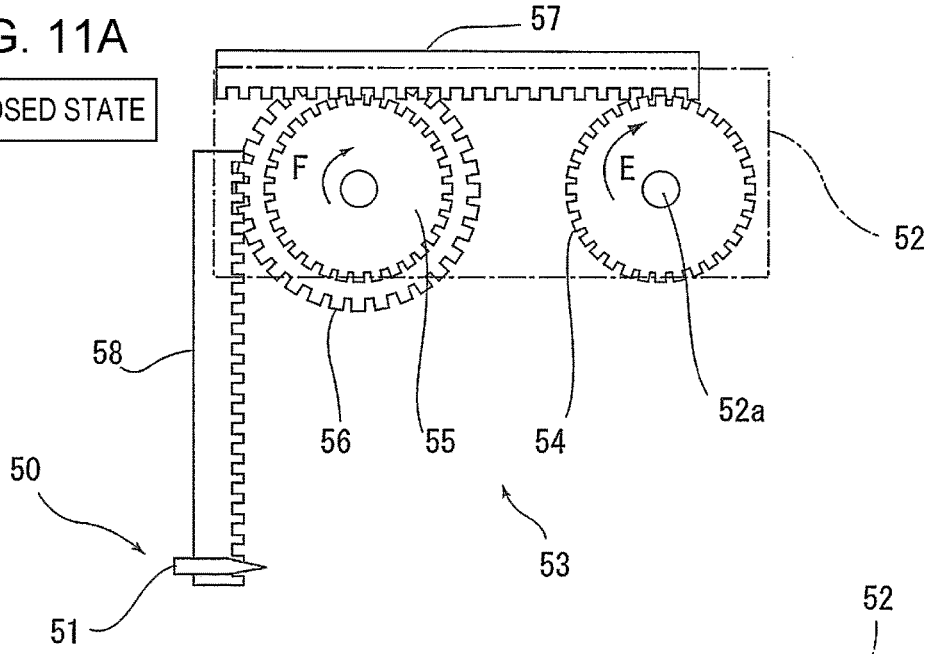
FIGS. 11A and 11B show a wiper moving mechanism in the cleaning mechanism according to the third embodiment.
Figure 11B:
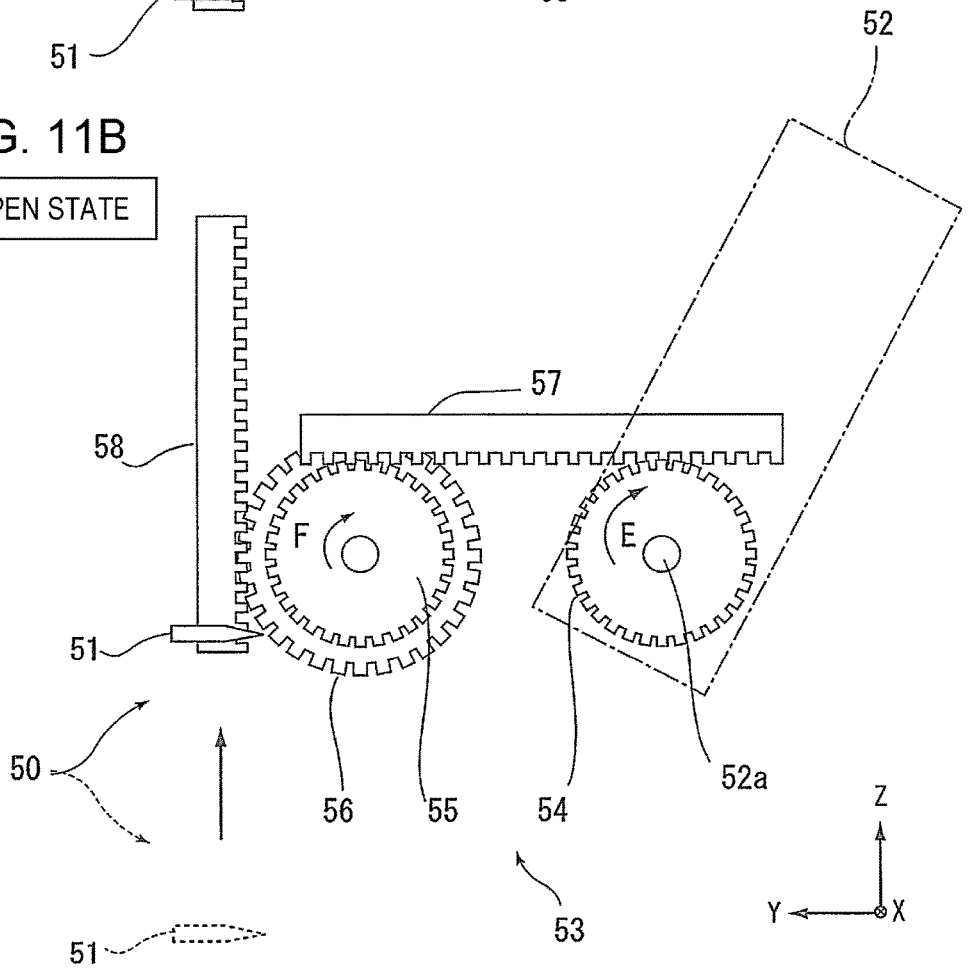

In a third embodiment, another example of the cleaning mechanism of the invention will be described with reference to FIGS. 10A to 11B. FIGS. 10A and 10B show a wiping operation performed by a cleaning mechanism according to the third embodiment. FIGS. 11A and 11B show a wiper moving mechanism in the cleaning mechanism according to the third embodiment.

In this embodiment, the ink tank 13 has a filling port cover 52 that opens and closes the filling port 15 (FIGS. 10A and 10B). More specifically, as shown in FIGS. 10A and 10B, the filling port cover 52 according to this embodiment is rotated about a rotation shaft 52*a* toward the back-surface side (−Y direction side) of the carriage 11 and has, at an end, a cap 21 for sealing the filling port 15.

In the cleaning mechanism 50 (FIGS. 10A and 10B) in the third embodiment, the wiper 51, serving as a "wiping portion", for wiping the level checking portion 13*a* is configured to move while being in contact with the level checking portion 13*a* in accordance with the opening and closing of the filling port cover 52. In this embodiment, when the filling port cover 52 is closed (FIG. 10A), the wiper 51 is located on the −Z-direction side of the level checking portion 13*a*, and when the filling port cover 52 is opened (FIG. 10B), the wiper 51 moves toward the +Z direction side.

The wiper 51 can be moved in accordance with the opening and closing of the filling port cover 52 by using, for example, a moving mechanism 53 (FIGS. 11A and 11B) that changes a turning operation of the filling port cover 52 to a moving operation in the Z direction. For example, the moving mechanism 53 includes a first pinion 54 provided coaxially with the rotation shaft 52*a* of the filling port cover 52, a first rack portion 57 to mesh with the first pinion 54, a second pinion 55 to mesh with the first rack portion 57 at a position on the front-surface side of the recording apparatus (+Y direction side) away from the first pinion 54, a third pinion 56 to rotate with the second pinion 55, and a second rack portion 58 to mesh with the third pinion 56. The wiper 51 is provided at an end of the linkage 46.

When the filling port cover 52 in a closed state (FIGS. 10A and 11A) is opened (FIGS. 10B and 11B), the first pinion 54 rotates in an arrow E direction, and the second pinion 55, which receives the turning force of the first pinion 54 via the first rack portion 57, and the third pinion 56, which rotates with the second pinion 55, rotate in an arrow F direction. When the third pinion 56 rotates in the arrow F direction, the second rack portion 58 moves in the +Z direction, thus moving the wiper 51 in the +Z direction. FIG. 11B shows, by a dashed line, the position of the wiper 51 before being moved. When the filling port cover 52 is closed, the wiper 51 moves in the −Z direction by the operations reverse to those performed when the filling port cover 52 is opened.

As a result of the wiper 51 moving in accordance with the opening and closing of the filling port cover 52, it is possible to wipe off the liquid (ink mist M, ink spilled when refilling the ink tank, etc.) deposited on the level checking portion 13*a* when the filling port cover 52 is opened and closed to refill the ink tank 13.

Fourth Embodiment

Figure 12:
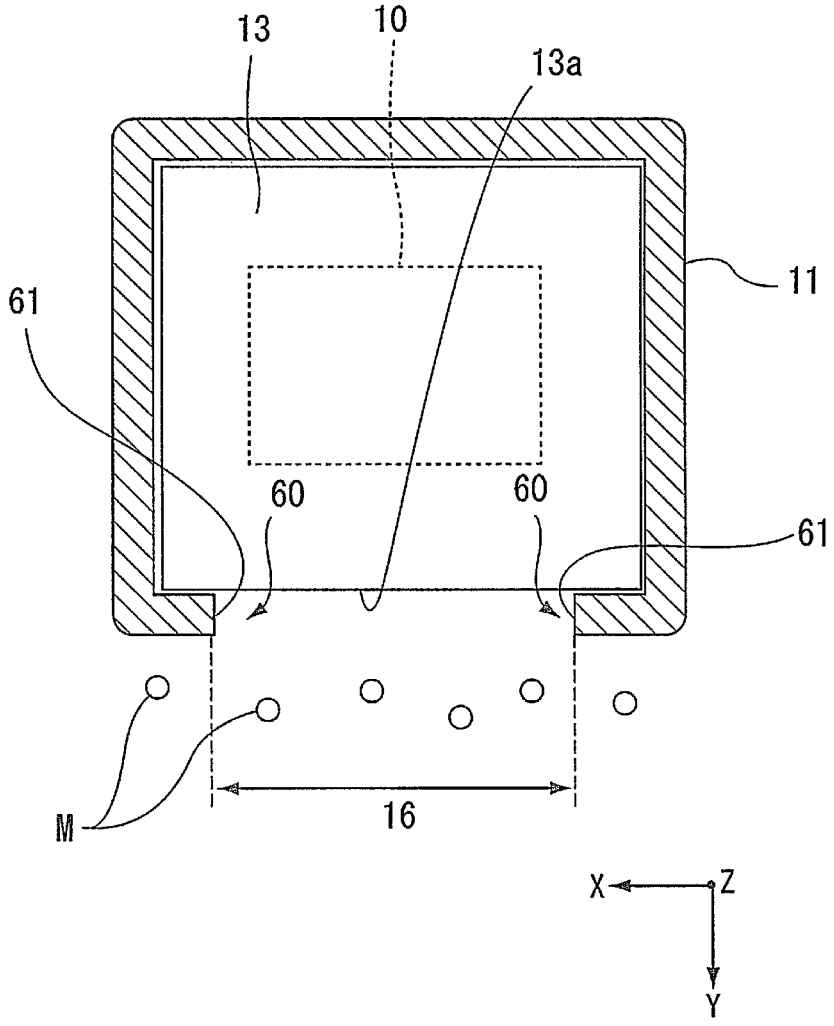
FIG. 12 shows an example upright portion, serving as a liquid-deposition suppressing portion, according to the fourth embodiment.
Figure 13:
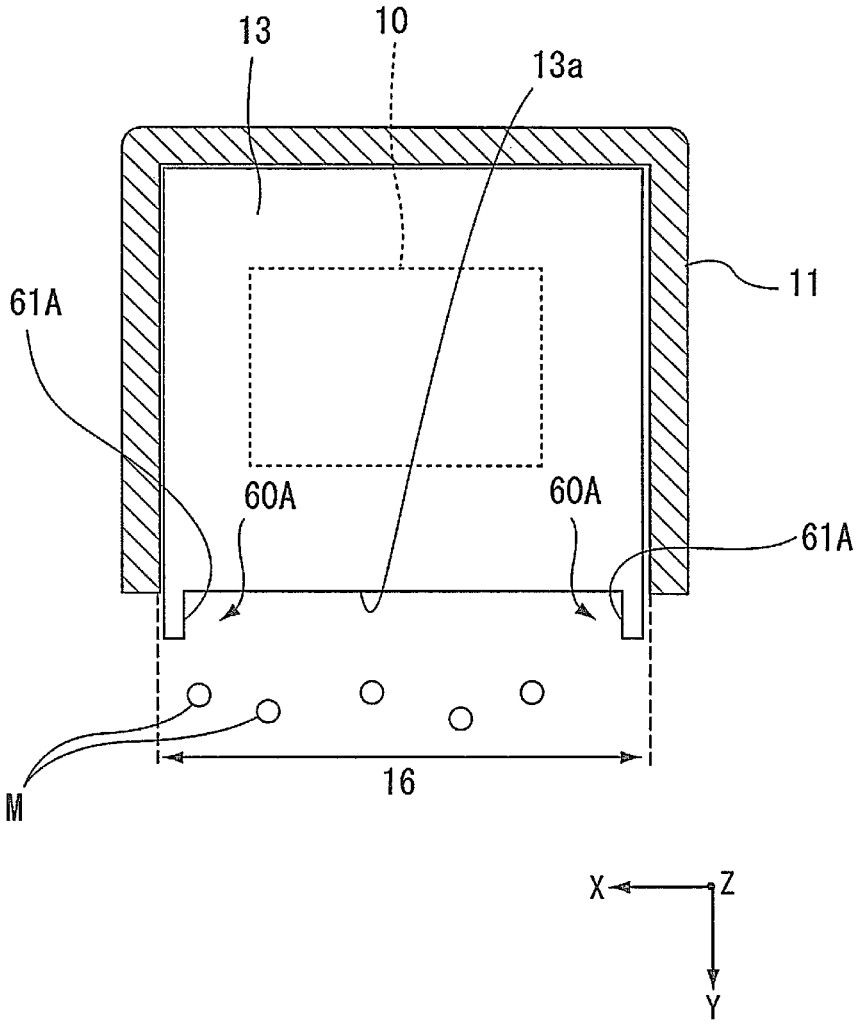
FIG. 13 shows a modification of the upright portion.
Figure 14:
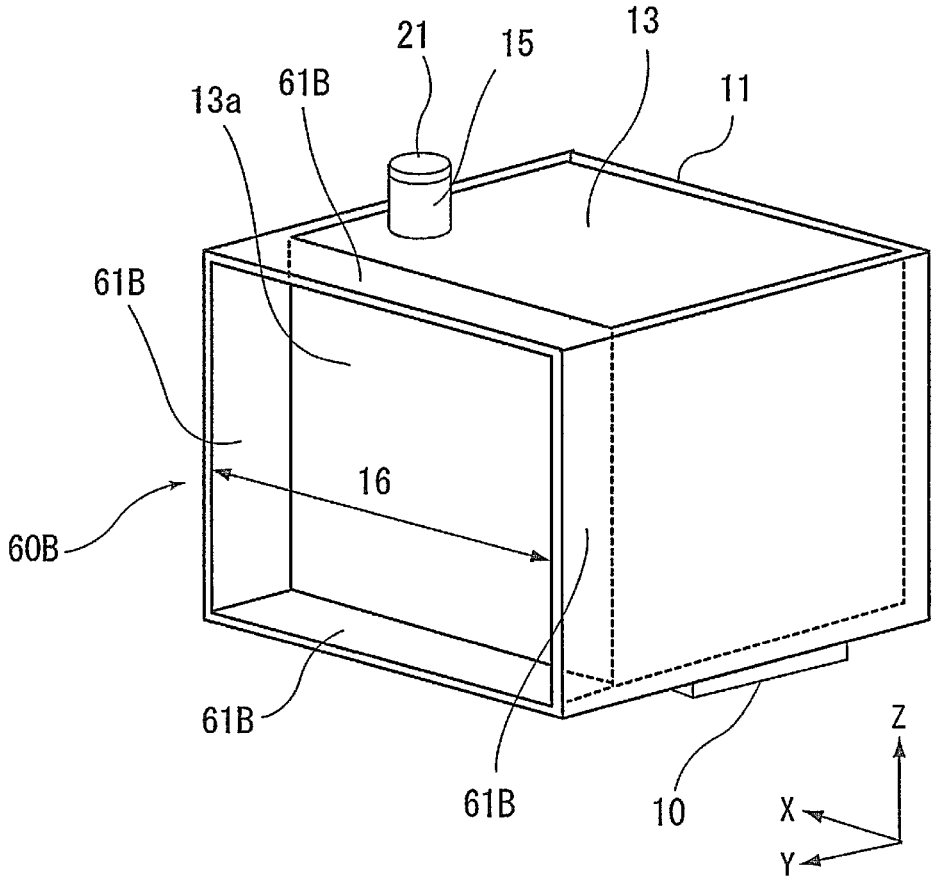
FIG. 14 shows another modification of the upright portion.

In the first to third embodiments, the "cleaning mechanism" for cleaning the ink (including ink mist), serving as the "liquid", deposited on the level checking portion 13*a* has been described. However, it is also possible to provide a liquid-deposition suppressing portion 60 for suppressing deposition of ink on the level checking portion 13*a*. In the fourth embodiment, an example of the liquid-deposition suppressing portion 60 of the invention will be described with reference to FIGS. 12 to 14. FIG. 12 shows an example upright portion, serving as a liquid-deposition suppressing portion. FIG. 13 shows a modification of the upright portion. FIG. 14 shows another modification of the upright portion.

A liquid-deposition suppressing portion 60A may be configured to have an "upright portion" that is provided upright in, at least, an area around the level checking portion 13*a*. In this embodiment, as shown in FIG. 12, the upright portions 61, 61 are provided on both sides of the level checking portion 13*a* in the carriage moving direction (X direction). The upright portions 61, 61 shown in FIG. 12 are formed on the edges of the first viewing portion 16 in the carriage 11.

The ink mist M generated by discharge of ink from the recording head 10 provided at the bottom of the carriage 11 tends to move in the X direction with an airflow caused by the movement of the carriage 11 in the X direction. However, because the ink mist M is blocked by the upright portions 61, 61, serving as the liquid-deposition suppressing portion 60, the ink mist M is unlikely to be deposited on the level checking portion 13*a*. Hence, the good visibility of the level checking portion 13*a* is maintained for a long time. The upright portions 61, 61 may be provided around the level checking portion 13*a* to block the liquid (ink) scattering or flying toward the level checking portion 13*a*. Furthermore, when the liquid-deposition suppressing portion 60 is provided, the "cleaning mechanism" does not need to be provided in the printer. However, it is possible to use both the liquid-deposition suppressing portion 60 and the "cleaning mechanism".

First Modification of Fourth Embodiment

As shown in FIG. 13, the "upright portions", serving as the liquid-deposition suppressing portion 60, may also be provided on the ink tank 13. In the liquid-deposition suppressing portion 60A (FIG. 13), serving as a first modification of the fourth embodiment, wall-shaped upright portions 61A, 61A are formed on the surface of the level checking portion 13*a*, just inside the first viewing portion 16 provided on the carriage 11. Similarly to the upright portions 61, 61 in FIG. 12, the upright portions 61A, 61A are also provided on both sides of the level checking portion 13*a* in the carriage moving direction (X direction).

Second Modification of Fourth Embodiment

Furthermore, as shown in FIG. 14, the "upright portions" may be provided so as to completely surround the level checking portion 13*a*. A liquid-deposition suppressing portion 60B (FIG. 14), serving as a second modification of the fourth embodiment, has an upright portion 61B on each of the upper, lower, right, and left sides of the level checking portion 13*a*, that is, on both sides in the height direction of the recording apparatus (Z direction) and on both sides in the carriage moving direction (X direction). Thus, the level checking portion 13*a* is surrounded by the four upright portions 61B. By providing the upright portions 61B not only on both sides of the level checking portion 13*a* in the X direction, but also above the level checking portion 13*a*, it is possible to inhibit the ink spilled by accident from the filling port 15 during refilling from dripping and being deposited on the level checking portion 13*a*. Furthermore, because the upright portion 61B is provided also below the level checking portion 13*a*, which is close to the recording head 10, it is possible to more effectively suppress the deposition of ink mist on the level checking portion 13*a*.

Other Modification of Liquid-Deposition Suppressing Portion

In the fourth embodiment and the first and second modifications thereof, the upright portions 61 (FIG. 12), 61A (FIG. 13), or 61B (FIG. 14) are provided around the level checking portion 13*a* to physically prevent the deposition of liquid on the level checking portion 13*a*. Other than this configuration, for example, ink mist, serving as the liquid, may be guided to a place other than the level checking portion 13*a*, or the ink mist may be moved away from the level checking portion 13*a*.

An example configuration for moving the ink mist away from the level checking portion 13*a* is an air-blower or a mist attraction portion that quickly moves the ink mist generated by discharge of ink from the recording head 10 away from the moving area of the carriage 11.

An example configuration for guiding the ink mist to a place other than the level checking portion 13*a* is a static-electricity generator that charges the outer surface of the carriage 11 with static electricity by means of sliding contact with the carriage 11 when the carriage 11 moves. By using such a static-electricity generator, it is possible to attract the ink mist to the outer surface of the carriage 11 and to collect the ink mist. In particular, if the carriage 11 is formed from a conductive material, such as a conductive metal or ceramics, and the ink tank 13 is grounded, the ink mist is more easily attracted to the carriage 11. Thus, it is possible to reduce the risk of deposition of ink mist on the ink tank 13, including the level checking portion 13*a*.

Furthermore, when the second viewing portion 17 (FIG. 1), which is provided in the housing 2 and through which the level checking portion 13*a* can be viewed through the first viewing portion 16, is formed as a communication hole communicating between the inside and the outside of the housing 2, such as an opening or a cutaway portion, the ink mist generated in the housing 2 can be released to the outside through the second viewing portion 17. As a result, it is possible to suppress the deposition of mist on the inside components of the recording apparatus, including the level checking portion 13*a*. In other words, the second viewing portion 17 can be used as the "deposition suppressing portion".

The invention is not limited to the above-described embodiments, and may be modified within the scope of the invention described in the claims, and such modifications are of course included in the scope of the invention.

The entire disclosure of Japanese Patent Application No. 2017-061430, filed Mar. 27, 2017 is expressly incorporated by reference herein.

What is claimed is:

1. A recording apparatus comprising:

a recording unit that discharges liquid on a medium to perform recording; and a carriage having the recording unit and capable of moving in a width direction intersecting a medium transport direction, wherein the carriage carries at least one liquid container that stores the liquid to be supplied to the recording unit and that has a filling port through which the liquid is poured from a refilling container, the liquid container has a level checking portion that is formed of a transparent material through which the liquid level can be viewed, and the carriage has a first viewing portion through which the level checking portion of the liquid container can be viewed and a cleaning mechanism that wipes off the liquid deposited on the level checking portion.

2. The recording apparatus according to claim 1, wherein the cleaning mechanism is a wiping portion that can move relative to the level checking portion while being in contact therewith.

3. The recording apparatus according to claim 2, further comprising:

a housing that accommodates the carriage therein and constitutes the exterior of the recording apparatus; and an opening/closing cover that opens and closes a portion of the housing and allows the level checking portion to be viewed through the first viewing portion when opened, wherein the wiping portion is configured to move while being in contact with the level checking portion in accordance with the opening and closing of the opening/closing cover.

4. The recording apparatus according to claim 3, wherein the housing that accommodates the carriage therein and constitutes the exterior of the recording apparatus has a second viewing portion through which the level checking portion can be viewed through the first viewing portion.

5. The recording apparatus according to claim 4, wherein, when the carriage is located at a home position, at least a portion of the first viewing portion and at least a portion of the second viewing portion overlap each other, and the cleaning mechanism is provided on a home-position side of the carriage.

6. The recording apparatus according to claim 2, further comprising a filling port cover that opens and closes the filling port in the liquid container, wherein the wiping portion is configured to move while being in contact with the level checking portion in accordance with the opening and closing of the filling port cover.

7. The recording apparatus according to claim 2, further comprising a housing that accommodates the carriage therein and constitutes the exterior of the recording apparatus, wherein the wiping portion is fixed to the housing and is configured to move relative to the level checking portion while being in contact therewith in accordance with the movement of the carriage in the width direction.

8. The recording apparatus according to claim 1, wherein the level checking portion is waterproofed.

9. A recording apparatus comprising:

a recording unit that discharges liquid on a medium to perform recording; and a carriage having the recording unit and capable of moving in a width direction intersecting a medium transport direction, wherein the carriage carries at least one liquid container that stores the liquid to be supplied to the recording unit and that has a filling port through which the liquid is poured from a refilling container, the liquid container has a level checking portion that is formed of a transparent material through which the liquid level can be viewed, and the carriage has a first viewing portion through which the level checking portion of the liquid container can be viewed and a liquid-deposition suppressing portion that suppresses deposition of the liquid on the level checking portion.

10. The recording apparatus according to claim 9, wherein the liquid-deposition suppressing portion includes an upright portion that is provided upright in, at least, an area around the level checking portion.

11. The recording apparatus according to claim 9, wherein the housing that accommodates the carriage therein and constitutes the exterior of the recording apparatus has a second viewing portion through which the level checking portion can be viewed through the first viewing portion.

12. The recording apparatus according to claim 11, wherein the second viewing portion is an opening or a cutaway portion provided in the housing.

* * * * *